US011910874B1

(12) United States Patent
Roman

(10) Patent No.: US 11,910,874 B1
(45) Date of Patent: Feb. 27, 2024

(54) SYSTEM FOR DECORATING A WEARABLE ITEM

(71) Applicant: Jean Michael C. Roman, Coral Springs, FL (US)

(72) Inventor: Jean Michael C. Roman, Coral Springs, FL (US)

( * ) Notice: Subject to any disclaimer, the term of this patent is extended or adjusted under 35 U.S.C. 154(b) by 0 days.

(21) Appl. No.: 17/463,149

(22) Filed: Aug. 31, 2021

Related U.S. Application Data

(60) Provisional application No. 63/078,386, filed on Sep. 15, 2020.

(51) Int. Cl.
*A43B 3/00* (2022.01)

(52) U.S. Cl.
CPC ..... *A43B 3/0078* (2013.01)

(58) Field of Classification Search
CPC ..... A43B 3/0078; A43B 3/18; A43B 3/24; A43B 3/244; A43B 21/36; A43B 21/39; A43B 21/40; A43B 21/47; A43B 23/24; A43B 23/25; A41D 27/08; G06F 21/02; G06F 21/023; A44B 11/001; A44B 11/2592; A44B 11/2584; Y10T 24/45796; A41F 9/00
USPC ..... 36/136, 100, 101; 2/245, 244, 246; 24/437, 584.1, 590.1
See application file for complete search history.

(56) References Cited

U.S. PATENT DOCUMENTS

| | | | | |
|---|---|---|---|---|
| 1,333,466 | A * | 3/1920 | Colby | A43B 3/0078 2/245 |
| 1,728,763 | A * | 9/1929 | Katzman | A43B 23/24 2/245 |
| 3,204,346 | A * | 9/1965 | Lockard | A43B 3/24 36/15 |
| 5,331,753 | A * | 7/1994 | Rodibaugh | A43B 13/00 40/636 |
| 5,740,557 | A * | 4/1998 | Reid | A42B 1/248 2/244 |
| 7,421,806 | B2 | 9/2008 | Braynock | |
| 9,226,543 | B2 | 1/2016 | Campbell | |
| 9,955,757 | B1 * | 5/2018 | Ng | A43B 23/24 |
| 10,021,940 | B2 | 7/2018 | Bathum | |
| 10,264,843 | B1 * | 4/2019 | Whitcomb | G09F 21/02 |
| 2002/0116851 | A1 * | 8/2002 | Ferguson | G09F 3/207 40/636 |

(Continued)

FOREIGN PATENT DOCUMENTS

| | | | |
|---|---|---|---|
| KR | 100770246 | | 10/2007 |
| KR | 200464073 | Y1 * | 12/2012 |
| WO | 2019056111 | | 3/2019 |

*Primary Examiner* — Jameson D Collier
*Assistant Examiner* — Matthew R Marchewka
(74) *Attorney, Agent, or Firm* — John Rizvi; John Rizvi, P.A—The Patent Professor®

(57) ABSTRACT

A system for decorating a wearable item includes a support member and a detachable member. One of the support member and the detachable member includes a protrusion, and the other of the support member and the detachable member includes a recess configured to couple with the protrusion. With the protrusion slidably received in the recess, the detachable member may be secured to the support member, allowing a surface of the detachable member, optionally provided with a logo or decorative indicia, to be affixed to the support member and displayed.

15 Claims, 7 Drawing Sheets

(56) References Cited

U.S. PATENT DOCUMENTS

| | | | | |
|---|---|---|---|---|
| 2005/0005478 | A1* | 1/2005 | James | A43B 3/0078 36/71 |
| 2009/0007459 | A1* | 1/2009 | Barnett | A43B 3/0031 36/136 |
| 2012/0144562 | A1* | 6/2012 | Ferrara | A41F 9/002 2/338 |
| 2012/0186105 | A1* | 7/2012 | Kemp | A43B 21/48 36/100 |
| 2013/0068118 | A1* | 3/2013 | Bartow | A43B 13/00 101/127 |
| 2013/0174327 | A1* | 7/2013 | Baum | A43B 3/242 2/244 |
| 2014/0147618 | A1* | 5/2014 | Schmoll | A43B 1/0081 428/100 |
| 2017/0224047 | A1* | 8/2017 | Walker | A43B 7/1495 |
| 2018/0213881 | A1 | 8/2018 | Yun | |
| 2018/0242680 | A1 | 8/2018 | Arin | |
| 2019/0142105 | A1 | 5/2019 | Boal | |
| 2021/0219664 | A1* | 7/2021 | Dowling | A43B 3/0078 |

* cited by examiner

SYSTEM FOR DECORATING A WEARABLE ITEM

CROSS-REFERENCE TO RELATED APPLICATION

This application claims the benefit of U.S. Provisional Patent Application No. 63/078,386, filed on Sep. 15, 2020, which is incorporated herein by reference in its entirety.

FIELD OF THE INVENTION

The present invention relates generally to wearable items, and more particularly, to a decoration system for a wearable item or apparel in which a decorative element is removably attachable to the wearable item or apparel.

BACKGROUND OF THE INVENTION

Conventional footwear items are produced for many different purposes and in a wide variety of styles. Some footwear items are manufactured and sold strictly for aesthetic reasons, while other, more specialized items, are produced for specific uses (football cleats, hiking shoes, running shoes, etc.). Despite these differences in styles, one thing that most footwear manufacturers have in common is the desire to bear graphics or a targeted logo in a prominent location on the footwear item.

It is fairly evident in society today that many people enjoy wearing clothes (shirts, hats, and shoes in particular) that display logos or graphics relating to major brands, fashion labels, sports teams, schools, and other points of style or pride. Apparel and other fashion items (such as footwear) that incorporate a logo or graphics typically enjoy a premium price point in relation to other generic competing items. This premium can often serve as a selling point or source of pride for the wearer as many consumers enjoy representing popular logos or custom indicia on their apparel.

Although interchangeable footwear components are known in the art, they most often require the use of sloppy or non-durable fasteners such as hook and loop fasteners or zipper-based items. While these fasteners may be relatively easy to use, their presentation is often lacking and can further be inexact or imprecise when placing the components onto the footwear item.

Typically, logos on footwear come as a fixed panel or other non-customizable display. These displays may be affixed to the footwear item through a variety of methods, but the most common include machine stitching, high pressure adhesives, and/or digital printing. No matter which of these methods is used, they all produce a logo or graphic display that is permanent and non-changeable on that particular item.

Accordingly, there is need for a solution to at least one of the aforementioned problems. For instance, there is clearly a need for an easy-to-use and adaptable logo display mechanism that may be incorporated on multiple footwear or other wearable items, or other apparel uses.

SUMMARY OF THE INVENTION

The present invention is directed to a decoration system for a shoe or other wearable item or fashion apparel. The decoration system may include a support member and a detachable member. The invention allows for a shoe or other wearable item to incorporate multiple modular designs through the selective replacement of the detachable member. The system allows for the detachable member to include different decorative features which may be interchangeably attached to the support member in a precise manner.

In a first implementation of the invention, a decoration system for a shoe or other wearable item comprises a support member and a detachable member. One of the support member and the detachable member of the system includes a protrusion. In turn, the other of the support member and the detachable member includes a recess configured to slidably receive and couple with the detachable member. The protrusion includes an outer panel and a base, wherein the outer panel extends outwardly beyond the perimeter of the base. The recess of the detachable member includes side slots that are configured to receive the outer panel of the protrusion and retain the protrusion thereupon. The detachable member provides a surface upon which a custom logo or decorative indicia may be produced and displayed. The detachable member may be slid down upon and frictionally retained by the protrusion. The support member may be configured in a generally rounded shape with tips extending horizontally away from its center. The detachable member may be configured as a circular member having a rectangular shaped portion extending from each of its sides. The support member and the detachable member may be created from a plurality of materials including nylon-based plastics, acrylic plastic polymer, various metals (aluminum, steel, precious metals, or others) or other suitable materials. Production of the system may be accomplished through additive manufacturing technology such as selective laser sintering or other suitable methods.

In another implementation, a system for decorating a wearable item may include a support member and a detachable member. The support member may be affixable to a wearable item. One of the support member and the detachable member may include a protrusion. The other of the support member and the detachable member may include a recess and an outer opening formed along the recess and in spatial communication with the recess. The recess and the outer opening may be configured to slidably receive the protrusion along a sliding direction. The system may be configured to reversibly move between a first configuration and a second configuration. In the first configuration, the protrusion may be slidably received through a first area of the outer opening and within a first section of the recess, and may be removable out of the recess to disconnect the detachable member from the support member. In the second configuration, the protrusion may be slidably received through a second area of the outer opening and within a second section of the recess, and may be retained within the second section by the detachable member, maintaining the detachable member attached to the support member.

In a second aspect, the first section of the recess may be arranged below the second section of the recess, and the first area of the outer opening may be arranged below the second area of the outer opening.

In another aspect, the system may be maintained in the second configuration by gravity, and may be manually movable from the second configuration to the first configuration.

In another aspect, the protrusion and recess may be vertically displaceable relative to one another.

In another aspect, the detachable member may include a pair of wall protrusions at the second area of the outer opening. The wall protrusions may render the second area narrower than the first area. Each wall protrusion may form a respective slot in the second section of the recess. The protrusion may be slidable along the slots.

In yet another aspect, the protrusion may include a base and an outer panel. The base may be slidably received along the outer opening. The outer panel may be slidably received along the recess. The pair of wall protrusions may retain the outer panel within the recess when the system is arranged in the second configuration.

In another aspect, the outer panel may be snugly and slidably received inside the slots such that relative displacement of the protrusion and recess in at least one direction perpendicular to the sliding direction is prevented.

In another aspect, the outer panel may be snugly and slidably received inside the slots such that relative displacement of the protrusion and recess in any direction perpendicular to the sliding direction is prevented.

In another aspect, the recess and first area of the outer opening may conform in shape and size to the outer panel of the protrusion.

In yet another aspect, the second area of the outer opening may conform in shape and size to the base of the protrusion.

In another aspect, the detachable member may include a central portion and at least one side portion. The at least one side portion may extend from the central portion perpendicularly to the sliding direction.

In another aspect, the at least one side portion may include a first side portion and a second side portion extending from opposite sides of the central portion.

In another aspect, the first area of the outer opening may be arranged below the second area of the outer opening. The first section of the recess may be arranged below the second section of the recess. The protrusion and recess may be vertically displaceable relative to one another. The first and second side portion extend from opposite sides of the central portion in a left-to-right direction.

In yet another aspect, the detachable member may include an outer side arranged opposite to the support member and visible when the system is arranged in the second configuration. The outer side may include one or more indicia.

In another aspect, the detachable member and support member may rest against one another when the system is arranged in the second configuration.

In another aspect, the protrusion and the recess may be rectangular.

In another aspect, the system may further include at least one magnetic fastener disconnectably securing the detachable member and the support member to one another in the second configuration.

In yet another aspect, the support member may be deformable to conform with a contour of the wearable item.

In another aspect, the support member of the system may include a plurality of horizontal indentations or segments within an upper portion on its front side. The shape of the support member may also take an alternate form from the generally rounded shape with horizontally extending tips.

In another aspect, the detachable member may be configured as an alternative shape or design with the circular member having a rectangular shaped portion extending from each of its sides.

In another aspect, the support member may include a plurality of decorative segments or stripes configured within a front surface of the support member. The decorative segments may be colored or left blank depending on the stylistic needs of the user.

In another aspect, the outer side of the detachable member may include a blank surface that is useful for receiving an interchangeable or customizable logo or graphics item. The customizable logo or graphics item may be provided directly from a manufacturer or alternatively from the user themselves.

In yet another aspect, the outer side of the detachable member may include a logo or graphical decoration that is raised above the surface of the detachable member or alternative carved into the detachable member. This may provide unlimited manufacturing and design options for both mass-production companies as well as individual users who may be looking to provide their own personal and unique touch to a wearable item.

In another aspect, the system may include one or more magnets on the support member and detachable member. These magnets may be used in addition to, or in replacement of, the protrusion included on the support member and the recess created within the detachable member.

In another aspect, the system may include ferromagnetic materials embedded within the support member, the detachable member, or within both. The embedded ferromagnetic materials may allow for magnetic coupling to occur between the support member and detachable member.

In another aspect, the support member and corresponding detachable member may be configured for use with sportswear, shoes, hats, bags, or other apparel items. This versatility may provide a mechanism by which a user or apparel manufacturer can customize interchangeable decorations across a series of wearable items. This may also be useful for allowing a user to replace an original logo or decoration which may have been worn down due to repetitive or harsh use.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a decoration system for a wearable item (e.g., footwear, belt, hat, bag, etc.) or a fashion apparel, which can be attached to the item to provide customizable, interchangeable, and adaptable designs.

Figure 1:
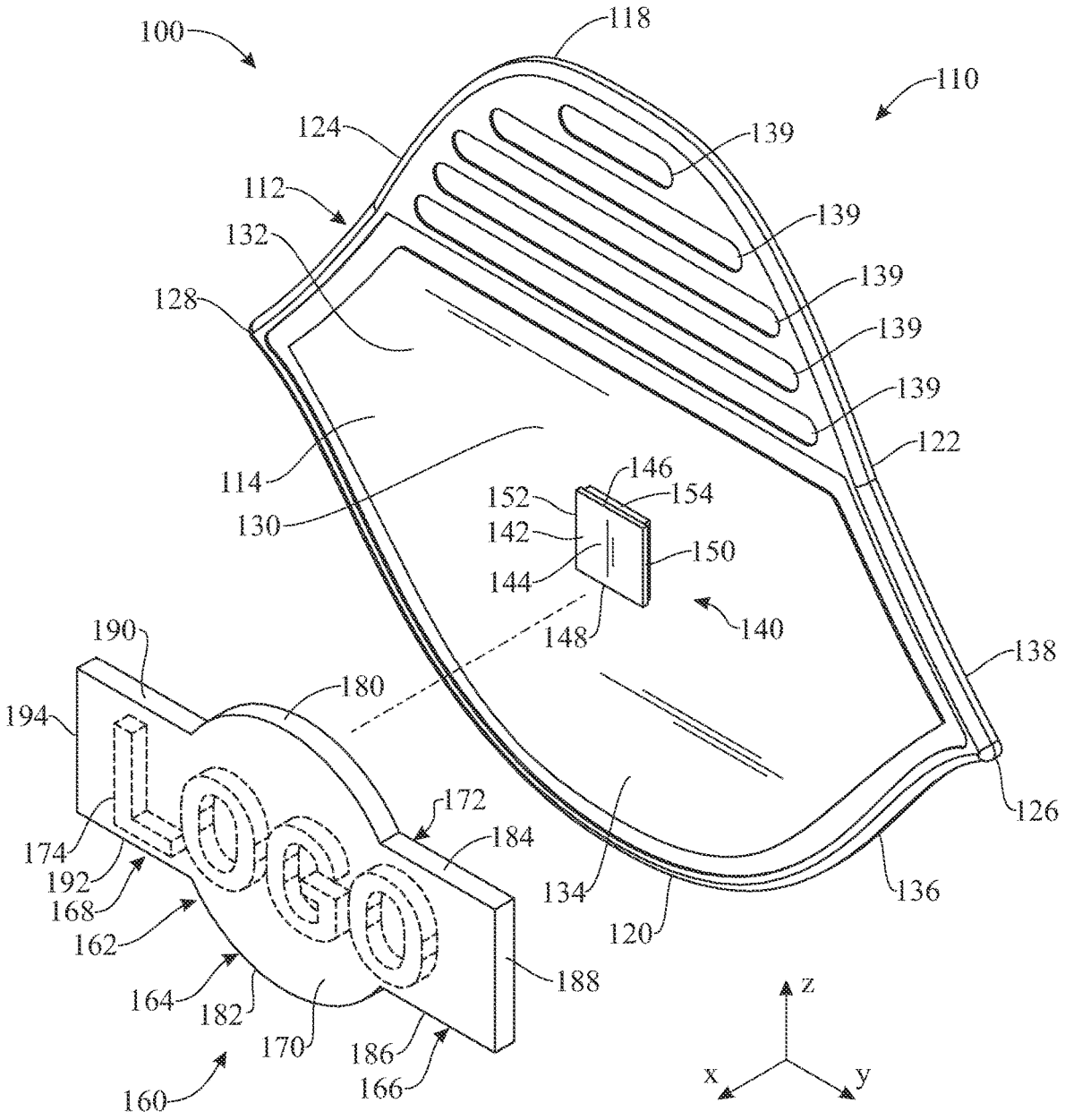
FIG. 1 presents an exploded front side isometric view of the decoration system for a shoe or other wearable item, the system including a detachable member displaying a logo or indicia, and a support member having a protrusion on a front side thereof, in accordance with a first illustrative embodiment of the present invention.
Figure 2:
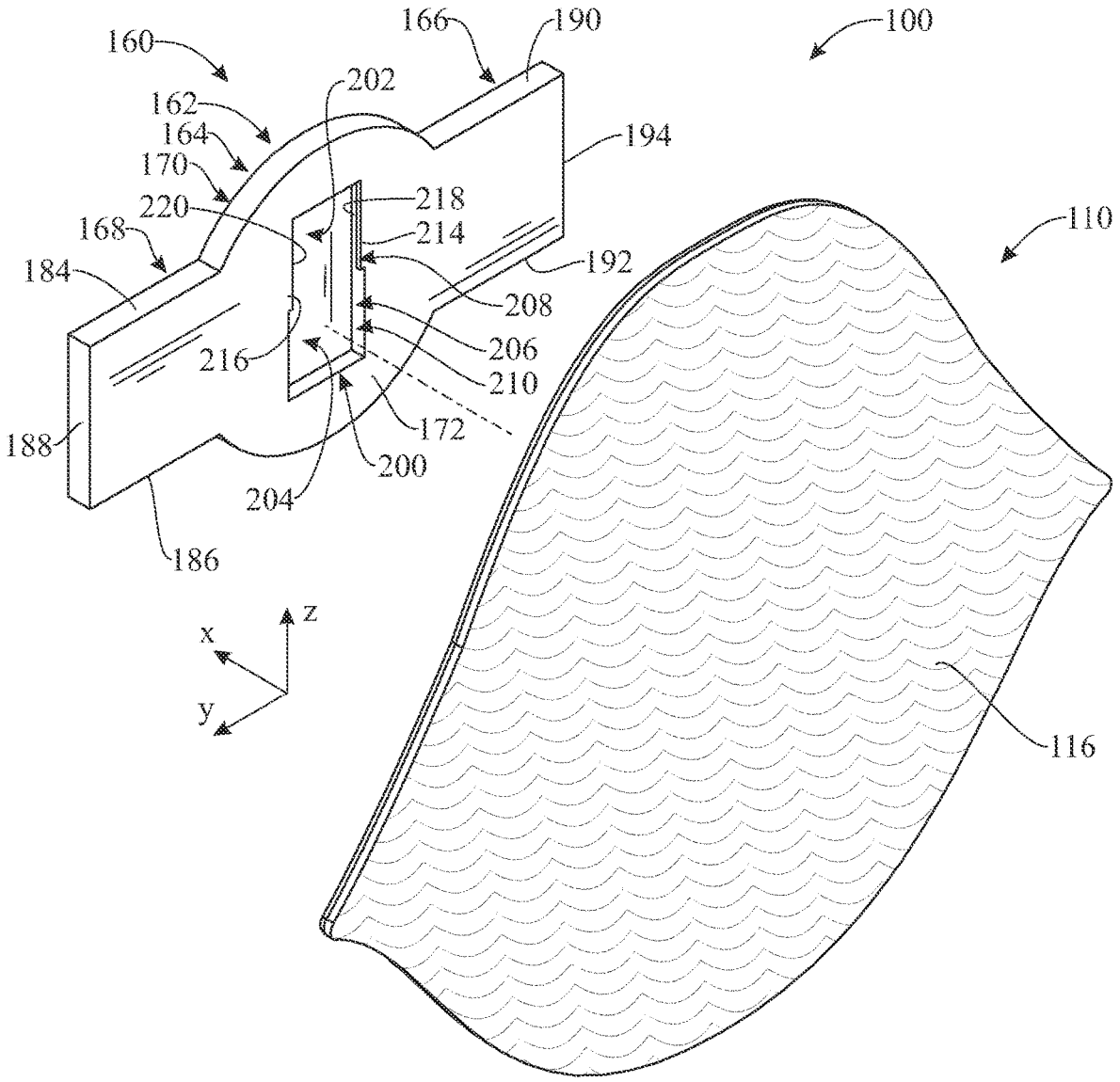
FIG. 2 presents an exploded rear side isometric view of the support member and detachable member illustrated in FIG. 1.

Referring initially to FIGS. 1 and 2, a decoration system for a shoe or other wearable item or fashion apparel, hereinafter system 100, is illustrated in accordance with a first exemplary embodiment of the present invention. As shown, the system 100 includes a support member 110 having a main body 112, which may be affixed to a wearable item (e.g., a shoe, bag, hat, etc.). In some non-limiting examples, the main body 112 may be integrally-formed with the wearable item, or may be manufactured separately to the wearable item (e.g., by injection molding, or additive manufacturing or 3D-printing) and adhered to or otherwise attached to the wearable item. The main body 112 may be generally planar or plate-shaped, as shown, and may be flexible or otherwise shaped and sized to conform to the shape and size of a wearable item. The main body 112 and may include a front side 114 and a rear side 116, which may end in a top edge 118, a bottom edge 120, a right side edge 122, and a left side edge 124. The right side edge 122 may include a right side tip 126, and a left side tip 128. The right side tip 126 and left side tip 128 may extend away in a pointed configuration from the generally rounded configuration of the support member 110. The main body 112 may include a central portion 130, an upper portion 132 arranged above the central portion 130, and a lower portion 134 arranged below the central portion 130. The main body 112 may also include a lower periphery 136 extending along the edge of the main body 112 in between the right side tip 126 and the left side tip 128. Likewise, the support member 110 may include an upper periphery 138 extending along the edge of the support member 110 in between the right side tip 126 and the left side tip 128.

At the upper portion 132 of the main body 112 of the support member 110, the support member 110 may include embedded designs. The designs may be in the form, for instance and without limitation, of elongated ovals. These designs may include a plurality of segments 139. The segments 139 may be parallel to one another and may each have a length such that the opposite right and left ends of the plurality of segments 139 follow the contour of the right side edge 122 and left side edge 124 of the support member 110, respectively.

Figure 4:
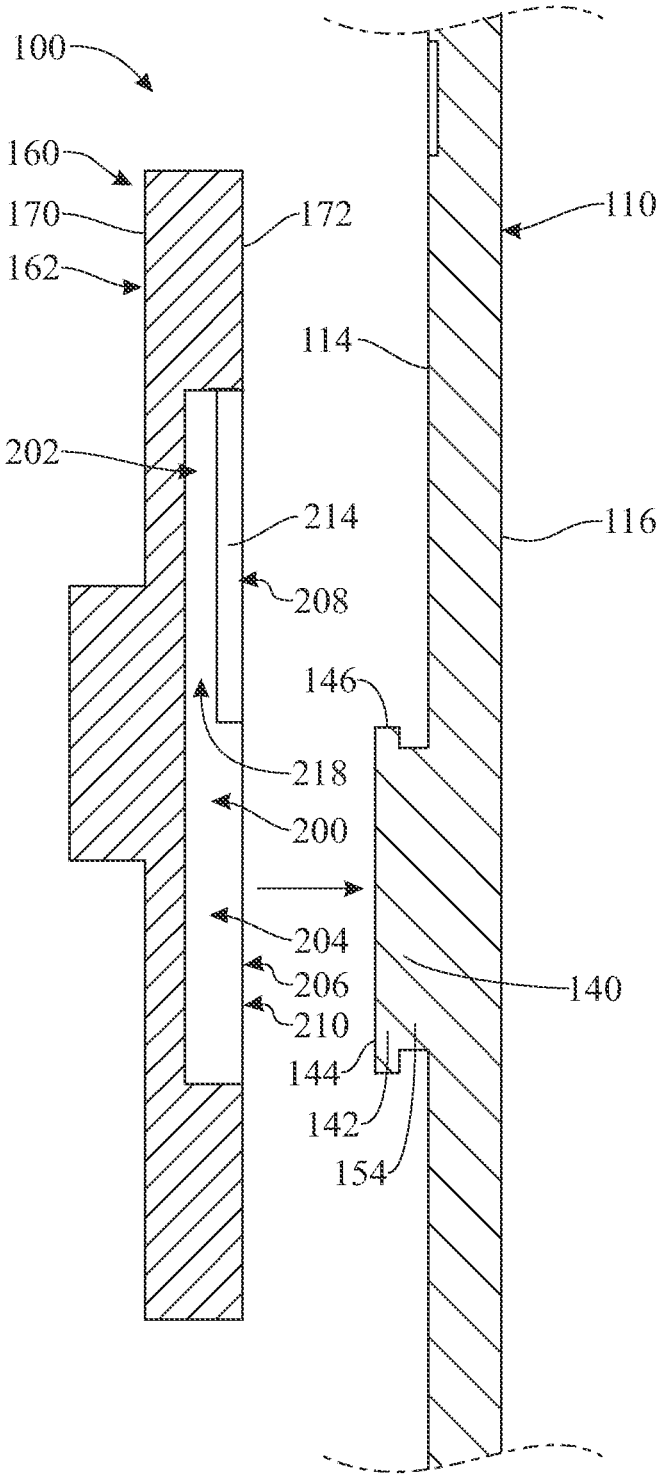
FIG. 4 presents a cross-sectional side elevation view of the support member and detachable member, more particularly illustrating the detachable member in preparation for coupling to the support member.

As shown in FIGS. 1 and 2, the system 100 may include a detachable member 160. The detachable member 160 may be formed as a separate part relative to the support member 110, and may be manufactured, for instance and without limitation, by injection molding, or by additive manufacturing or 3D-printing. The detachable member 160 may include a main body 162 comprising a central portion 164 and right and left wings or portions 166 and 168, respectively, which may extend outward from the central portion 164, oppositely to one another and in a left-to-right direction y. The main body 162 of the detachable member 160 may be relatively thin and planar, as shown. The central portion 164 of the main body 162 may be formed, for instance, as a disc or circular-shaped body or plate. The right and left portions 166 and 168 may be formed, for instance, as elongated bodies or plates, to facilitate exerting a manual pushing or pulling force thereon for purposes that will be described hereinafter; for example, the right and left portions 166 and 168 may be rectangular, as shown. The main body 162 of the detachable member 160 may further include a front side 170 (FIG. 1) and a back side 172 (FIG. 2), which may be generally parallel to one another, as also shown in FIG. 4. The front side 170 of the detachable member 160 may display indicia 174 such as, but not limited to, a logo. The central portion 164 of the main body 162 may include a top edge 180 and a bottom edge 182. The right portion 166 of the main body 162 may include a top edge 184 and a bottom edge 186, which may extend from the top and bottom edges 180 and 182 of the central portion 164, respectively, and may further include a right side edge 188 extending between outer ends of the top and bottom edges 184 and 186. Similarly, the left portion 168 of the main body 162 may include a top edge 190 and a bottom edge 192, which may extend from the top and bottom edges 180 and 182 of the central portion 164, respectively, and may further include a left side edge 194 extending between outer ends of the top and bottom edges 190 and 192.

The support member 110 of the system 100 may serve as a mounting area upon which the detachable member 160 may couple with and retain in position. For example, the support member 110 may include a protrusion 140 located for instance in the middle of the central portion 130, such as in alignment with the right and left side tips 126 and 128. The protrusion 140 may feature a generally square-shaped configuration and include an outer panel 142. The outer panel 142 may end in a front surface 144, and may further include a top edge 146, a bottom edge 148, a right side edge 150, and a left side edge 152. The protrusion 140 may also include a base 154 carrying the outer panel 142. As shown, the base 154 may be affixed to the support member 110 and may extend frontward from the front side 114 of the support member 110. The base 154 may elevate or separate the outer panel 142 and front surface 144 of the outer panel 142 away from the front side 114 of the support member 110. Further still, the base 154 may be smaller in size and perimeter than the outer panel 142 and the front surface 144 in such a manner that the top edge 146, the bottom edge 148, the right side edge 150, and the left side edge 152 all extend beyond the base 154 so as to create a gap in between the base 154 and the front side 114 of the support member 110.

Referring now to FIG. 2, there is shown the support member 110 and detachable member 160 of the system 100 of FIG. 1 from a rear perspective revealing the back sides 116 and 172 of the support member 110 and detachable member 160, respectively. At the back side 172, the detachable member 160 may include a cavity or recess 200 having an upper section 202 and a lower section 204. The recess 200 may end in an outer opening 206, which may be divided into an upper area 208 and a lower area 210, the upper and lower areas 208 and 210 of the outer opening 206 arranged facing, and in spatial communication with, the upper and lower sections 202 and 204 of the recess 200, respectively. The recess 200 may be suited for slidably coupling with the protrusion 140 (illustrated in FIG. 1) of the support member 110 in such a manner that the detachable member 160 is retained in position frictionally and/or by gravity until a user chooses to lift and remove the detachable member 160 from the support member 110.

As further shown in FIG. 2, the lower section 204 of the recess 200 and the lower area 210 of the outer opening 206 may each be configured in a similar square shape and outline as the protrusion 140 of the support member 110, and may be configured to couple with the protrusion 140 when placed thereupon, and more particularly, to allow to fit the outer panel 142 of the protrusion 140 into the lower section 204 of the recess 200. The detachable member 160 may further include outer left and right side wall protrusions 214 and 216 extending towards one another at the upper section 202 of the recess 200, such that the upper area 208 of the outer opening 206, which is in spatial communication with the upper section 202 of the recess 200, is narrower than the upper section 202. As further shown, a left side slot 218 and a right side slot 220 are formed in front of the left and right side wall protrusions 214 and 216, respectively, by the narrowing effect provided by said outer walls or wall protrusions 214 and 216. The left side slot 218 and right side slot 220 are arranged in a vertical direction z, perpendicular to the left-to-right direction y, and are provided to at least partially occupy the gap between the outer panel 142 of the protrusion 140 and the front side 114 of the support member 110, retaining the outer panel 142 within the upper section 202 of the recess 200, and thereby retaining the detachable member 160 against the support member 110 by friction and/or gravity upon being slid into position by a user.

Figure 3:
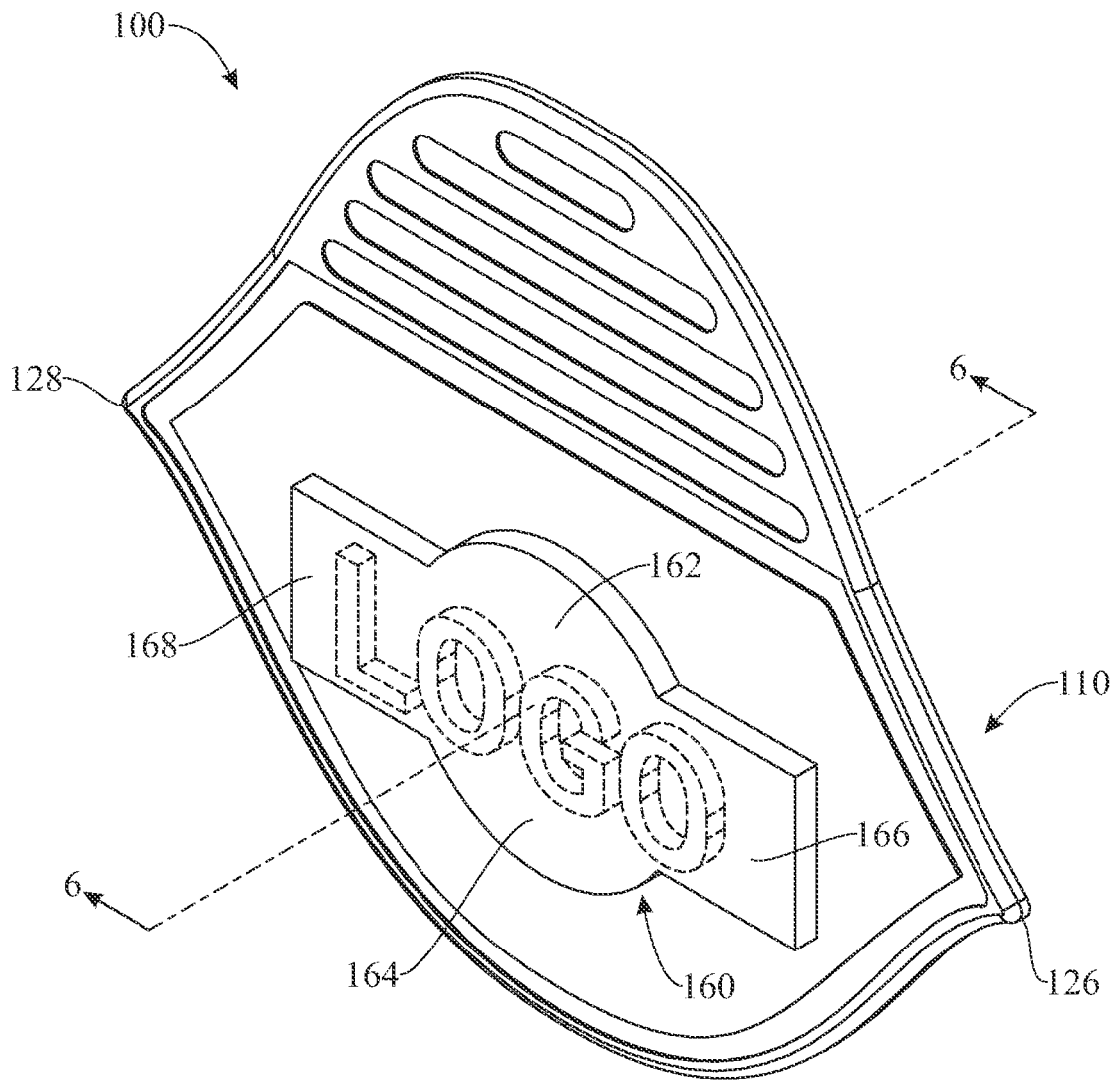
FIG. 3 presents a front side isometric view of the decoration system, illustrating the support member and detachable member coupled together.

The illustration of FIG. 3 shows the detachable member 160 coupled to the support member 110 in an attached state over the front side 114 at the central portion 130 of the support member 110. While attached, the detachable member 160 remains coupled to the support member 110 by friction and/or gravity, directly below the upper portion 132 of the front side 114 and horizontally in line with the central axis existing between the right side tip 126 and the left side tip 128. The detachable member 160, and more particularly, the front side 170 thereof, may feature a logo, indicia or other graphics making it suitable for selective positioning and interchangeable replacement on a wearable item. For instance and without limitation, the logo or graphics may be centrally positioned on the front side 170 of the detachable member 160 at the central portion 164 and extending from the left portion 168 to the right portion 166. A user may remove and replace the detachable member 160 on the support member 110 with another detachable member 160 at any point due to premature wear or breakdown of the detachable member 160, or additionally to changing styles or preferences of the user.

Figure 5:
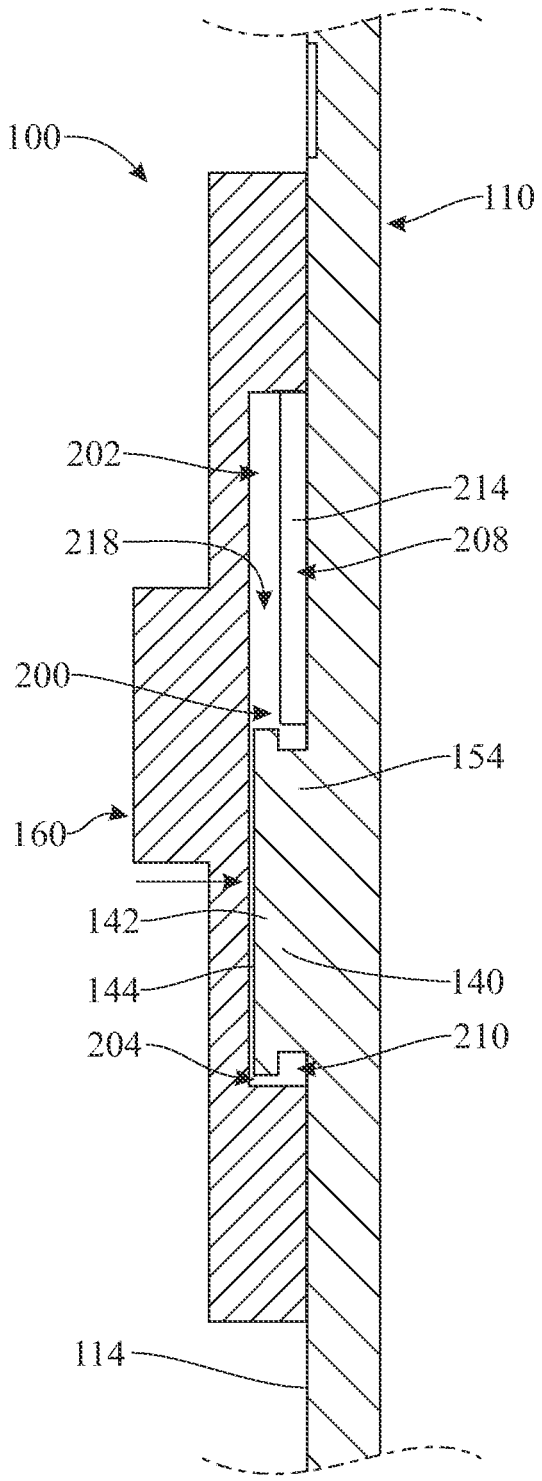
FIG. 5 presents a cross-sectional side elevation view of the support member and detachable member, more particularly illustrating the detachable member in place over the protrusion, prior to sliding the detachable member and protrusion relative to one another into a fully coupled position.
Figure 6:
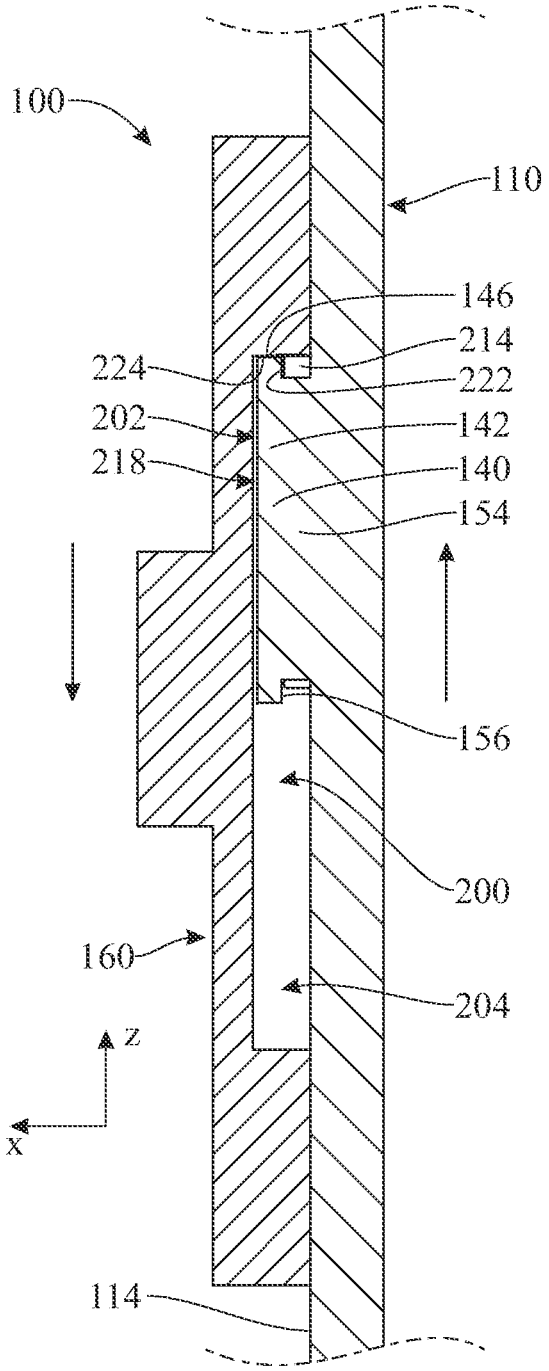
FIG. 6 presents a cross-sectional side elevation view of the support member and detachable member in a fully coupled position.

The illustrations of FIGS. 4-6 show a sequence of cross-sectional side elevation views reflecting the assembly process for attaching the detachable member 160 to the support member 110. With reference initially to FIG. 4, the lower section 204 of the recess 200 is dimensionally configured to receive the outer panel 142 and the base 154 of the protrusion 140. The protrusion 140 may enter the lower section 204 of the recess 200 through the lower area 210 of the outer opening 206, just below the left side slot 218 and right side slot 220 and just below the wall protrusions 214 and 216 (FIG. 2).

Referring next to FIG. 5, a side sectional view of the support member 110 and detachable member 160 is shown, illustrating the detachable member 160 placed over and onto the protrusion 140 of the support member 110. More specifically, the support member 110 and the detachable member 160 are positioned against each other with the protrusion 140 inserted completely within the lower section 204 of the recess 200. The protrusion 140 and specifically the outer panel 142 may enter the lower section 204 just below the left side slot 218 and the right side slot 220 (FIG. 2). As shown, the upper section 202 of the recess 200 may be configured to receive the outer panel 142 of the protrusion 140 once the detachable member 160 is moved downwards with respect to the support member 110, i.e. once the protrusion 140 is shifted towards the slots 218, 220. The detachable member 160 may be coupled to the support member 110 and held in place by the left side slot 218 and right side slot 220 (FIG. 2) mating frictionally and/or by gravity about the protrusion base 154. The protrusion base 154 may be configured in size and dimensions to slidably insert within and along the left side slot 218 and right side slot 220 (FIG. 2).

Next, as shown in FIG. 6, the detachable member 160 and support member 110 may be moved relative to one another to cause the protrusion 140 to engage with the slots 218, 220. Sufficient sliding of the protrusion 140 along the recess 200 causes the detachable member 160 to become arranged in place over the protrusion 140 after the detachable member 160 has been vertically slid into a fully coupled position. Sliding of the detachable member 160 relative to the support member 110 may be facilitated by exerting an upward force on the left portion 168 and right portions 166 of the detachable member 160, which protrude outwardly from the central portion 164 (FIG. 1). As shown, the upper section 202 of the recess 200 may be configured to receive the outer panel 142 of the protrusion 140 once the detachable member 160 is moved downwards with respect to the support member 110. The detachable member 160 may be coupled to the support member 110 such that the outer panel 142 is received within the upper section 202 of the recess 200, including within the left and right side slots 218 and 220 of the upper section 202, the base 154 is received between the wall protrusions 214 and 216.

In the fully coupled configuration, the detachable member 160 and support member 110 may abut or rest against one another, as shown. The detachable member 160 may be held in place in a front-to-back direction x, perpendicular to the left-to-right direction y and to the vertical direction z, by a rear side 156 of the outer panel 142 resting on an inner side 222 of the wall protrusions 214 and 216. Alternatively or additionally, the detachable member 160 may be held in place in the vertical direction z by the top edge 146 of the outer panel 142 of the protrusion 140 resting on an inner wall 224 of the detachable member 160, as shown in FIG. 6. The detachable member 160 may alternatively or additionally be held in place in the left-to-right direction y by having the width of the outer panel 142 (i.e. the dimension along the left-to-right direction y) generally match the width of the upper section 202 of the recess 200, such that the outer panel 142 is received relatively snugly, yet slidably, within the slots 218, 220.

In some embodiments, the coupling between the recess 200 of the detachable member 160 and the protrusion 140 of the support member 110 may be enhanced by friction. For instance, the right side edge 150 the left side edge 152 of the outer panel may be shaped and/or sized to frictionally adjust within the left side slot 218 and right side slot 220, respectively. Alternatively or additionally, the coupling between the recess 200 of the detachable member 160 and the protrusion 140 of the support member 110 may be enhanced by gravity, such as by the aforementioned contacting and resting of the inner wall 224 of the detachable member 160 on the top edge 146 of the outer panel 142 of the protrusion 140.

Figure 7:
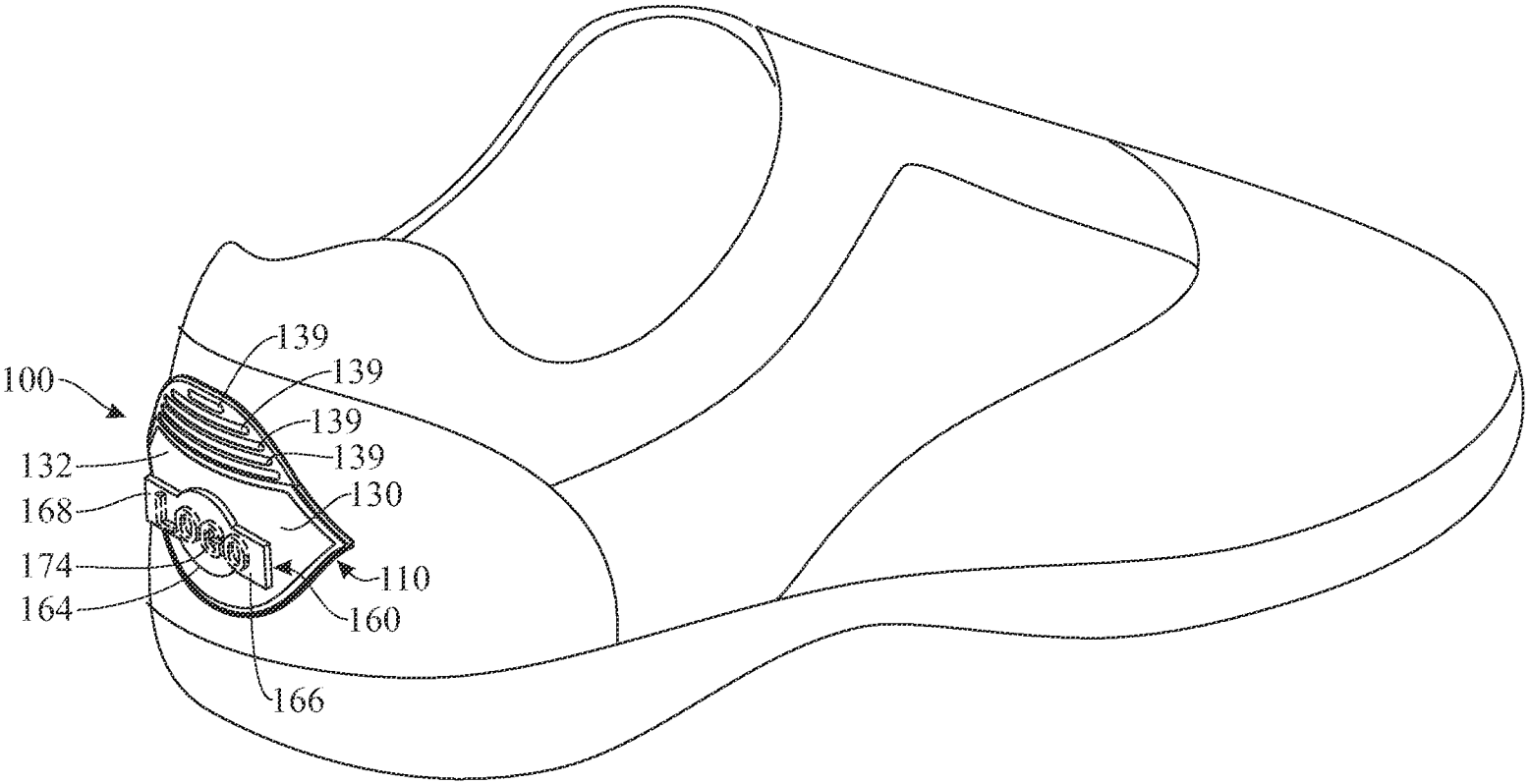
FIG. 7 presents a side perspective view of the decorative system of FIG. 1, including the support member and detachable member installed upon a footwear item.

The illustration of FIG. 7 shows an illustrative application of the system 100, on the back of a standard footwear item. The support member 110 of the system may be affixed to the footwear item (or, in other applications, on other pieces of clothing, wearable items or accessories, fashion apparels, or the like). The detachable member 160 is shown fully coupled to the central portion 130 of the main body 112 of the support member 110. As coupled, the detachable member 160 rests centrally just below the upper portion 132 of the main body 112 of the support member 110. The detachable member 160 may include indicia 174 or graphic designs which may be prominently displayed, for instance and without limitation, across the right portion 166, the central portion 164, and the left portion 168 of the main body 162 of the detachable member 160. The detachable member 160 may allow a user to manually interchange logos, graphics, or other indicia by removing one detachable member 160 and easily replacing it with a different logo or indicia on another detachable member 160. As further shown in the figure, in some embodiments, the support member 110 may deform to conform to the outer contour of the footwear or other wearable item. In some embodiments, as shown, the detachable member 160 may maintain its original planar shape, which may, for instance, facilitate accessing and exerting an upward force on the left and right portions 168 and 166, respectively, of the detachable member 160 to displace the detachable member 160 relative to the support member 110 and disconnect the detachable member 160 from the support member 110.

Though not specifically shown herein, embodiments are contemplated in which the protrusion 140 and the mating recess 200 are provided, instead, on the detachable member 160 and support member 110, respectively, without departing from the scope of the present disclosure.

Further alternative embodiments are contemplated in which the detachable member 160 and support member 110 of the system 100 may be configured to include one or more magnets, and one or more mating magnets or ferromagnetic materials, to assist with the coupling of the detachable member 160 to the support member 110. For example, the detachable member 160 may include a single magnet in the recess 200 for removable coupling to a single magnet configured within the body of the protrusion 140. In another alternative embodiment, the detachable member 160 may include a plurality of magnets configured on or within the back side 172 of the main body 160, at any one of the central portion 164, the left portion 168 and the right portion 166. The support member 110 may also then include a corresponding plurality of magnets configured on or within the front side 114 of the support member 110.

Further still, the detachable member 160 and support member 110 may include ferromagnetic materials in addition to plastics, polymers, metals, or other suitable materials. The ferromagnetic materials may be embedded within the detachable member 160 along with the support member 110, thereby making it easy for a user to selectively remove a detachable member 160 and then replacing it with a new or alternative detachable member 160. In addition, alternative embodiments may include the detachable member 160 and support member 110 configured in a variety of shapes, sizes, and dimensions to accommodate for a wider range of apparel items and applications.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A system for decorating a wearable item, the system comprising:

the wearable item, configured to be worn in an upright position;

a support member, affixed to the wearable item; and a detachable member; wherein the support member comprises a protrusion, the protrusion comprising a square-shaped outer panel and base carrying the outer panel, the outer panel comprising a first pair of opposite side edges and a second pair of opposite side edges, the outer panel wider than the base such that both the first pair of opposite side edges and the second pair of opposite side edges protrude outward from the base defining a gap between said first pair of opposite side edges and an outer surface of the support member and a gap between said second pair of opposite side edges and the outer surface of the support member; and the detachable member comprises a recess and an outer opening formed along the recess and in spatial communication with the recess, the recess and the outer opening configured to slidably receive the protrusion along a sliding direction parallel to the first pair of opposite side edges; wherein with the wearable item in the upright position, the system is configured to reversibly move between:

a first configuration, in which the protrusion is slidably received through a first area of the outer opening and within a first section of the recess, and is removable out of the recess to disconnect the detachable member from the support member, and a second configuration, in which the protrusion is slidably received through a second area of the outer opening and within a second section of the recess, wherein the first section of the recess is arranged below the second section of the recess and the first area of the outer opening is arranged below the second area of the outer opening, and in which the protrusion is retained within the second section by the detachable member being received between the first pair of opposite side edges and said outer surface of the support member, maintaining the detachable member attached to the support member; and further wherein with the wearable item in the upright position, the system is manually movable from the first configuration to the second configuration by displacing the detachable member downward along the sliding direction relative to the support member, and is manually movable from the second configuration to the first configuration by displacing the detachable member upward along the sliding direction relative to the support member.

2. The system of claim 1, wherein the system is maintained in the second configuration by gravity.

3. The system of claim 1, wherein the detachable member comprises a pair of wall protrusions at the second area of the outer opening, wherein the pair of wall protrusions renders the second area narrower than the first area, and wherein each wall protrusion of the pair of wall protrusions forms a respective slot in the second section of the recess, the protrusion being slidable along the respective slots.

4. The system of claim 3, wherein the base is slidably received along the outer opening and the outer panel is slidably received along the recess, the pair of wall protrusions retaining the outer panel within the recess when the system is arranged in the second configuration.

5. The system of claim 4, wherein the outer panel is snugly and slidably received inside the respective slots such that relative displacement of the protrusion and recess in at least one direction perpendicular to the sliding direction is prevented.

6. The system of claim 5, wherein the outer panel is snugly and slidably received inside the respective slots such that relative displacement of the protrusion and recess in any direction perpendicular to the sliding direction is prevented.

7. The system of claim 4, wherein the recess and the first area of the outer opening conform in shape and size to the outer panel of the protrusion.

8. The system of claim 4, wherein the second area of the outer opening conforms in shape and size to the base of the protrusion.

9. The system of claim 1, wherein the detachable member comprises a central portion and at least one side portion, the at least one side portion extending from the central portion perpendicularly to the sliding direction.

10. The system of claim 9, wherein the at least one side portion comprises a first side portion and a second side portion extending from opposite sides of the central portion.

11. The system of claim 1, wherein the detachable member comprises an outer side arranged opposite to the support member and visible when the system is arranged in the second configuration, the outer side comprising one or more indicia.

12. The system of claim 1, wherein the detachable member and the support member rest against one another when the system is arranged in the second configuration.

13. The system of claim 1, wherein the support member is deformable to conform with a contour of the wearable item.

14. A system for decorating a wearable item, the system comprising:

the wearable item, configured to be worn in an upright position;

a support member, affixed to the wearable item; and a detachable member; wherein the support member comprises a protrusion, the protrusion comprising a square-shaped outer panel and base carrying the outer panel, the outer panel comprising a first pair of opposite side edges and a second pair of opposite side edges, the outer panel wider than the base such that both the first pair of opposite side edges and the second pair of opposite side edges protrude outward from the base defining a gap between said first pair of opposite side edges and an outer surface of the support member and a aao between said second pair of opposite side edges and the outer surface of the support member; and the detachable member comprises a recess and an outer opening formed along the recess and in spatial communication with the recess, the recess and the outer opening configured to slidably receive the protrusion along a sliding direction parallel to the first pair of opposite side edges; wherein with the wearable item in the upright position, the system is configured to reversibly move between:

a first configuration, in which the protrusion is slidably received through a first area of the outer opening and within a first section of the recess, and is removable out of the recess to disconnect the detachable member from the support member, and a second configuration, in which the protrusion is slidably received through a second area of the outer opening and within a second section of the recess, wherein the first section of the recess is arranged below the second section of the recess and the first area of the outer opening is arranged below the second area of the outer opening, and further in which the protrusion is retained within the second section by the detachable member being received between the first pair of opposite side edges and said outer surface of the support member, maintaining the detachable member attached to the support member; and further wherein with the wearable item in the upright position, the system is manually movable from the first configuration to the second configuration by displacing the detachable member downward along the sliding direction relative to the support member, and is manually movable from the second configuration to the first configuration by displacing the detachable member upward along the sliding direction relative to the support member; and wherein with the wearable item in the upright position, the system is maintained in the second configuration by gravity.

15. A system for decorating a wearable item, the system comprising:

the wearable item, configured to be worn in an upright position;

a support member, affixed to the wearable item; and a detachable member, comprising an outer side provided with one or more indicia; wherein the support member comprises a protrusion, the protrusion comprising a square-shaped outer panel and base carrying the outer panel, the outer panel comprising a first pair of opposite side edges and a second pair of opposite side edges, the outer panel wider than the base such that both the first pair of opposite side edges and the second pair of opposite side edges protrude outward from the base defining a gap between said first pair of opposite side edges and an outer surface of the support member and a gap between said second pair of opposite side edges and the outer surface of the support member; and the detachable member comprises a recess and an outer opening formed along the recess and in spatial communication with the recess, the recess and the outer opening configured to slidably receive the protrusion along a sliding direction parallel to the first pair of opposite side edges; wherein with the wearable item in the upright position, the system is configured to reversibly move between:

a first configuration, in which the protrusion is slidably received through a first area of the outer opening and within a first section of the recess, and is removable out of the recess to disconnect the detachable member from the support member, and a second configuration, in which the protrusion is slidably received through a second area of the outer opening and within a second section of the recess, wherein the first section of the recess is arranged below the second section of the recess and the first area of the outer opening is arranged below the second area of the outer opening, and in which the protrusion is retained within the second section by the detachable member being received between the first pair of opposite side edges and said outer surface of the support member, maintaining the detachable member attached to the support member, and further in which the one or more indicia are visible; and wherein with the wearable item in the upright position, the system is manually movable from the first configuration to the second configuration by displacing the detachable member downward along the sliding direction relative to the support member, and is manually movable from the second configuration to the first configuration by displacing the detachable member upward along the sliding direction relative to the support member; and wherein with the wearable item in the upright position, the system is maintained in the second configuration by gravity.

* * * * *